US011745369B2

(12) United States Patent
Eijkelkamp et al.

(10) Patent No.: US 11,745,369 B2
(45) **Date of Patent: *Sep. 5, 2023**

(54) CUTTING UNIT

(71) Applicant: KONINKLIJKE PHILIPS N.V., Eindhoven (NL)

(72) Inventors: Marcus Franciscus Eijkelkamp, Peize (NL); Arjen De Boer, Drachten (NL); Martijn Frans Johan Nab, Drachten (NL); Roel Alexander Rethmeier, Drachten (NL); Willem Maat, Rohel (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 17/555,592

(22) Filed: Dec. 20, 2021

(65) Prior Publication Data

US 2022/0143850 A1 May 12, 2022

Related U.S. Application Data

(63) Continuation of application No. 16/649,702, filed as application No. PCT/EP2018/075728 on Sep. 24, 2018, now Pat. No. 11,235,480.

(30) Foreign Application Priority Data

Sep. 26, 2017 (EP) ..... 17193071

(51) Int. Cl.
*B26B 19/20* (2006.01)
*B26B 19/38* (2006.01)
*B26B 19/06* (2006.01)

(52) U.S. Cl.
CPC ..... *B26B 19/20* (2013.01); *B26B 19/3813* (2013.01); *B26B 19/06* (2013.01)

(58) Field of Classification Search
None
See application file for complete search history.

(56) References Cited

U.S. PATENT DOCUMENTS 1,348,293 A * 8/1920 Miller ..... B26B 19/20 30/201
1,745,997 A 2/1930 William
(Continued)

FOREIGN PATENT DOCUMENTS

| | | |
|---|---|---|
| EP | 3 888 860 A1 * | 10/2021 |
| JP | 2004181124 | 7/2004 |
| WO | 2010/033399 | 3/2010 |

OTHER PUBLICATIONS

International Search Report and Written Opinion dated Dec. 19, 2018 for International Application No. PCT/EP2018/075728 filed Sep. 24, 2018.

*Primary Examiner* — Hwei-Siu C Payer

(57) ABSTRACT

A cutting unit having a blade carrier carrying a cutting blade, and a guard. The guard includes a blade-facing surface engaging the cutting blade at a cut location, a planar guard contact surface for contacting the user's skin, where the guard contact surface is angled with respect to the blade-facing surface, and a guard extender separate from the guard. The guard extender includes a planar extension contact surface cooperating with the guard contact surface to provide an extended contact zone across the guard and the guard extender for contacting a user's skin. The blade-facing surface and the guard contact surface converge towards a tip of the guard, such that a cutting direction extends along the guard contact surface towards the tip. The extended contact zone may provide for improved stability and reliable orientation of the cutting unit for cutting while limiting material use.

6 Claims, 6 Drawing Sheets

(56) References Cited

U.S. PATENT DOCUMENTS

| | | | | |
|---|---|---|---|---|
| 1,861,616 | A | 6/1932 | Wahl | |
| 1,988,199 | A * | 1/1935 | Greco | B26B 19/20 30/202 |
| 2,291,438 | A | 7/1942 | Andis | |
| 2,916,820 | A | 12/1959 | Clark | |
| 2,974,412 | A * | 3/1961 | Clark | B26B 19/20 30/201 |
| 3,267,572 | A | 8/1966 | James | |
| 3,969,819 | A * | 7/1976 | Pepera | B26B 19/20 30/200 |
| 4,039,708 | A | 8/1977 | Okada | |
| 4,532,707 | A * | 8/1985 | Allen | B26B 19/20 30/200 |
| 9,545,729 | B2 * | 1/2017 | Buck, Jr. | B26B 19/063 |
| 10,653,224 | B2 | 5/2020 | Conersion | |
| 10,668,635 | B2 * | 6/2020 | Sablatschan | B26B 19/3846 |
| 10,702,999 | B2 * | 7/2020 | Iaccarino | B26B 19/063 |
| 10,967,530 | B2 * | 4/2021 | Eijkelkamp | B26B 19/38 |
| 11,235,480 | B2 * | 2/2022 | Eijkelkamp | B26B 19/3813 |
| 2011/0061243 | A1 | 3/2011 | Smit | |
| 2011/0173818 | A1 * | 7/2011 | Lacov | B26B 19/06 30/223 |
| 2012/0233865 | A1 | 9/2012 | Kammer | |
| 2016/0075039 | A1 * | 3/2016 | Werner | B26B 19/063 30/200 |
| 2022/0143850 | A1 * | 5/2022 | Eijkelkamp | B26B 19/3846 |

* cited by examiner

CUTTING UNIT

CROSS REFERENCE TO RELATED APPLICATIONS

This application is a continuation of U.S. application Ser. No. 16/649,702 filed Mar. 23, 2020, published as US 2020/0254636, now U.S. Pat. No. 11,235,480, which is the U.S. National Phase application under 35 U.S.C. § 371 of International Application No. PCT/EP2018/075728 filed Sep. 24, 2018, published as WO 2019/063453 on Apr. 4, 2019, which claims the benefit of European Patent Application Number 17193071.2 filed Sep. 26, 2017. These applications are hereby incorporated by reference herein.

FIELD OF THE INVENTION

The disclosure relates to a cutting unit for a hair cutting device.

BACKGROUND OF THE INVENTION

Known hair cutting devices, such as beard trimmers and clippers, comprise a handle which houses bulky components such as batteries and drive system, and a cutting unit attached to the handle. In known cutting units, a toothed cutting blade contacts a blade-facing surface of a guard, and can be driven to reciprocate over slots in the guard. In use, either the guard or a comb attached to the guard contacts skin of the user.

A comb can be used to set a desired cutting length between the skin of the user and a cut location defined where the cutting blade contacts the guard. In some cutting units, the guard may be moveable relative the cutting blade to vary the cutting length.

PCT patent application WO 2010/033399 A2 discloses a cover which might be placed over a clipper guard blade.

U.S. Pat. No. 1,861,616 discloses a clipper which length setting might be adjusted by moving the cutting blade and the guard blade relative to each other in a direction perpendicular to the reciprocating direction of the cutting blade. A mounting member is provided for mounting the guard blade.

SUMMARY OF THE INVENTION

In a broad aspect, the disclosure relates to the extension of a guard contact surface provided by a guard in a cutting unit of a hair cutting device. A guard extender is provided to define an extension contact surface which cooperates with the guard contact surface to define an extended contact zone over the guard and the guard extender.

According to a first aspect, there is provided a cutting unit for a hair cutting device, comprising: a blade carrier carrying a cutting blade; a guard comprising: a blade-facing surface engaging the cutting blade at a cut location; a planar guard contact surface for contacting skin of a user; and a plurality of hair-receiving slots extending between the guard contact surface and the blade-facing surface; wherein the guard contact surface is angled with respect to the blade-facing surface; and a guard extender separate from the guard, wherein the guard extender comprises a planar extension contact surface configured to cooperate with the guard contact surface to provide an extended contact zone across the guard and the guard extender for contacting skin of a user.

The blade-facing surface and the guard contact surface converge towards a tip of the guard. A cutting direction extends along the guard contact surface towards the tip. The guard extender is configured so that the extension contact surface is rearward of the guard contact surface with respect to the cutting direction.

The extension contact surface has a transverse extent along an axis perpendicular to the cutting direction. There is a gap along the cutting direction between the guard contact surface and at least a transverse portion of the extension contact surface which is elongate along a transverse direction substantially perpendicular to the cutting direction. By providing such a gap, the guard extender may be manufactured from a relatively low volume of material, whilst achieving a relatively large extent (i.e. length) of the extended contact zone across the guard and the guard extender along the cutting direction.

By providing the guard extender, the extended contact zone for contacting skin of a user extends across both the guard and the guard extender. The extended contact zone is therefore extended when compared to the contact surface provided by the guard alone, which may serve to improve stability of the cutting device when it is oriented so that the extended contact zone contacts the skin. Improving the stability may assist a user in recognizing when the cutting device is properly oriented. For example, a user may recognize an unstable response of the cutting device and contrast the response with a more stable response experienced at another orientation of the cutting device, to determine that the cutting device is oriented improperly. By providing the guard extender separate from the guide, different materials may be used to manufacture of the guard and the guard extender. For example, the guard may comprise a metal for structural stability at the interface with the cutting blade, whereas the guard extender may comprise a less expensive material, such as a plastics material.

The guard extender may be configured so that in use the guard extension contact surface cooperates with the guard contact surface so that the extended contact zone is substantially planar across the guard and the guard extender.

The extended contact zone may be substantially planar whilst having a step or angular offset between the guard contact surface and the extension contact surface. In particular, the guard extender may comprise a step at a boundary between the guard contact surface and the extension contact surface. For example, there may be a step at a boundary between the guard contact surface and the extension contact surface of up to 1 mm, or up 0.5 mm. A small step of up to 1 mm, or up to 0.5 mm may prevent pinching of skin or catching of hair at a joint between the guard extender and the guard (i.e. at the boundary between the guard contact surface and the extension contact surface). For example, the step may be configured so that the extension contact surface is recessed from the guard contact surface so that in use skin bridges from a rear end of the guard contact surface onto the extension contact surface. The extension contact surface may be angled with respect to the guard contact surface. For example, there may be a step between the guard contact surface and the extension contact surface, and the extension contact surface may be angled to intersect or return to a datum plane defined by the guard contact surface.

Alternatively, the guard extender may be configured so that in use the guard extension contact surface aligns with the guard contact surface so that it is substantially flush with the guard contact surface. Accordingly, there may be no appreciable step or angle between the extension contact surface and the guard contact surface.

The guard extender may be mounted to the guard. This may permit easy assembly of the guard extender for alignment with the guard. The guard extender may be removably mounted to the guard. This may permit ease of maintenance of the guard by removal of the guard extender, or replacement of the guard extender. Further, a user may advantageously remove the guard extender to permit cutting in highly concavely curved areas of skin, where the extended extended contact zone may otherwise bridge the curve.

The guard extender may comprise a plurality of hair-receiving slots configured to align with the hair-receiving slots of the guard. Accordingly, uncut hair may pass easily through the guard and guard extender.

The guard extender may comprise a plurality of fins defining the hair-receiving slots therebetween, wherein the fins extend from a common body for mounting on the guard. By providing the fins on a common body, assembly, alignment and optional removal of the fins may be conducted efficiently.

The guard extender may comprise a convex rocker surface rearward of the extension contact surface. The convex rocker surface may reduce the stability of the cutting device when the convex rocker surface contacts skin of the user, as it may be easy to rotate ("rock") the cutting device from forward or backward (i.e. to lift a tip of the guard away from the skin, or press it into the skin respectively). Such instability may be recognised by a user as compared with a more stable response of the cutting device when an extended contact zone contacts the skin. Accordingly, the user may recognise that the cutting device is oriented incorrectly when the convex rocker surface contacts the skin.

A rear end of the extension contact surface may terminate at an apex of the guard extender. A rear portion of the cutting unit rearward of the apex may define a valley profile rearward of the apex. In use when the cutting unit is oriented so that the rear portion contacts skin of the user, the skin may bridge the valley. The tactile feeling of bridging contact of skin with the rear portion of the cutting unit may be recognized by the user as compared with the feeling of an extended contact zone contacting the skin. Accordingly, the user may recognize that the cutting device is oriented incorrectly when the skin bridges the valley profile.

A rear end of the extension contact surface may terminate at an apex of the guard extender. The cutting unit may have an aft portion rearward of the apex which is configured so that rotation of the cutting unit about the apex for contact between the aft portion and skin of a user causes the cut location to lift away from the skin. Contact with the aft portion of the skin may therefore correspond with an incorrect orientation of the cutting device for cutting.

The guard extender may comprise a transverse contact member defining at least a portion of the extension contact surface. There may be a passageway between the transverse contact member and the guard. By providing the passageway, the material resources for manufacturing the guard extender may be relatively low. Further, the passageway may permit easy passage of grooming products away from the guard, without pressing against the skin.

The extension contact surface may be substantially continuous with the guard contact surface. The extension contact surface may be substantially continuous with the guard contact surface along at least a portion of the transverse extent of the extension contact surface.

The guard may be moveable along the blade carrier to vary the cutting length of the cutting unit. When the guard is moveable along the blade carrier, the range of cutting lengths is proportional to the range of travel of the guard relative the blade carrier along an extension axis by a factor of sin θ, where θ is the angle at which the guard contact surface is inclined relative the blade-facing surface. Accordingly, the range of cutting lengths becomes greater as the angle is increased. However, for a constant thickness of the guard, the length of the guard contact surface along the cutting direction will reduce as the angle θ increases. Consequently, in a cutting unit having a guard moveable along the blade carrier to vary the cutting length, the provision of a guard extender may enable a relatively high angle of the guard contact surface, whilst mitigating against the consequent relative low length of the guard contact surface.

According to a further aspect there is provided a hair cutting device comprising a housing unit and a cutting unit in accordance with the first aspect.

The invention may comprise any combination of features described herein, except such combinations are mutually exclusive.

BRIEF DESCRIPTION OF THE DRAWINGS

The invention will now be described by reference to the accompanying drawings, in which.

DETAILED DESCRIPTION OF EMBODIMENTS

Figure 1:
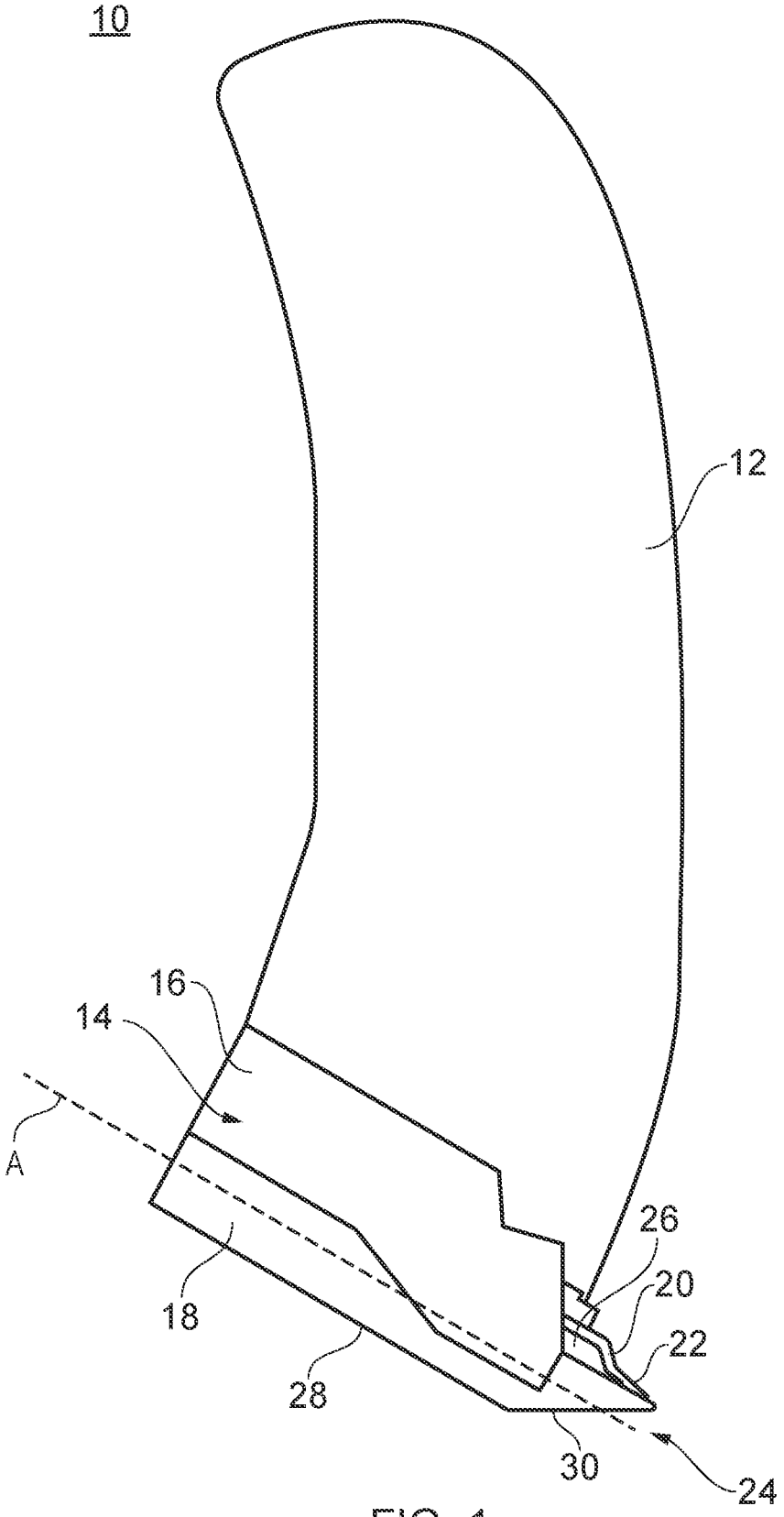
FIG. 1 schematically shows a side view of a cutting device comprising a housing unit and a cutting unit.

FIG. 1 shows a cutting device 10 comprising a housing unit 12 and a cutting unit 14. In this example, the housing unit 12 is generally in the form of a handle shaped for holding by a user. The housing unit 12 may comprise functional systems of the cutting device, such as a power system (e.g. batteries and a charging unit), and a drive for driving reciprocating movement of a cutting blade of the cutting device. In the orientation shown in FIG. 1, the housing unit 12 extends from a rounded upper end to a lower housing base for engaging the cutting unit 14.

The cutting unit 14 comprises a blade carrier 16 and a guard 18. In this example, the blade carrier 16 is statically mounted to the housing unit 12 so that it is provided against the lower housing base of the housing unit. The blade carrier has an outer profile substantially corresponding to an outer profile of the housing unit at the lower housing base. The profile may be substantially rectangular with rounded corners, for example.

A blade 20 is held by the blade carrier 16 so that it extends from a forward end of the blade carrier 16 (the right end as shown in FIG. 1) and terminates at a toothed edge 22 in a tip region 26 of the cutting unit 14. In this example, the blade carrier 16 holds the blade 20 for reciprocating movement along a transverse axis parallel with the cutting edge 22 (i.e. normal to the cross section as shown in FIG. 1). For example, such reciprocating movement may be driven by a drive of the housing unit 12.

In this example, the guard 18 is coupled to the blade carrier 16 so that it is disposed at a lower end of the cutting device 10 as shown in the orientation of FIG. 1. In this example, the guard 18 has a squat generally cuboidal body having a tip at a forward end of the guard (i.e. in the tip region of the cutting unit 14) defined by a chamfer in the lower side of the guard. The guard has a substantially planar upper surface 26 which extends over the tip, a parallel substantially planar lower surface 28 which terminates at a proximal end of the chamfered tip, and a chamfered surface 30 which defines the underside of the tip and is inclined with respect to the planar upper and lower surfaces 26, 28.

In this example, the guard 18 is coupled to the blade carrier 16 so that the planar upper surface 26 as shown in FIG. 1 opposes the blade 20 and may therefore be referred to as a blade-facing surface 26. In this particular example, the guard 18 is moveable forward and backward along the guard carrier 16 along an extension axis A parallel with the blade-facing surface 26 of the guard so that the blade-facing surface 26 slides past the cutting edge 22 of the blade 20. Such movement may vary a cutting length of the cutting unit as will be described in detail below.

The chamfered surface 30 is provided for contacting skin of the user, and is therefore referred to herein as a guard contact surface 30. When the guard contact surface 30 is held against skin of a user, a cutting length of the cutting unit 14 is equal to the distance from the guard contact surface 30 to a cut location defined where the blade edge 22 contacts the blade-facing surface 26 of the guard 18. The guard 18 comprises a plurality of slots between the blade-facing surface 26 and the guard contact surface 30 for receiving hairs for cutting and guiding the hairs to the cut location.

The guard 18 may be made of any suitable material. In this particular example, the guard 18 comprises stainless steel.

Figure 2:
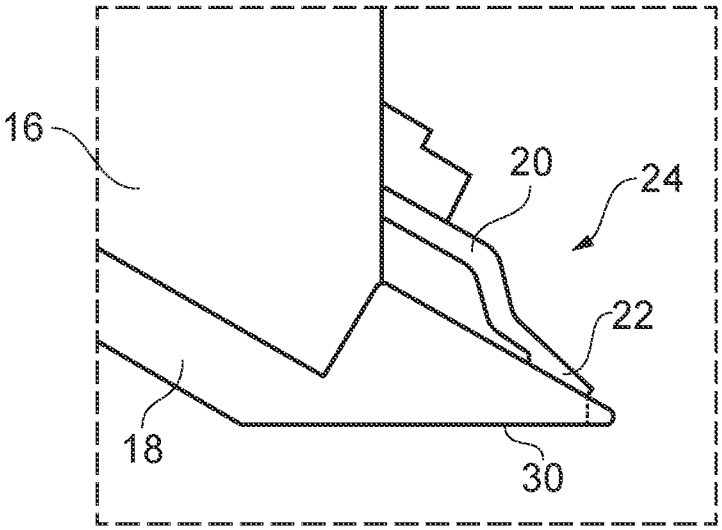
FIGS. 2 and 3 show side views of a tip region of the cutting unit in short and long cutting configurations respectively.

As will be appreciated, movement of the guard 18 along the extension axis A varies the cutting length. FIG. 2 shows an enlarged view of the tip region 24 of the cutting unit 14 with the guard in a first guard position corresponding to a short cutting length B between the guard contact surface 30 and the cut location.

Figure 3:
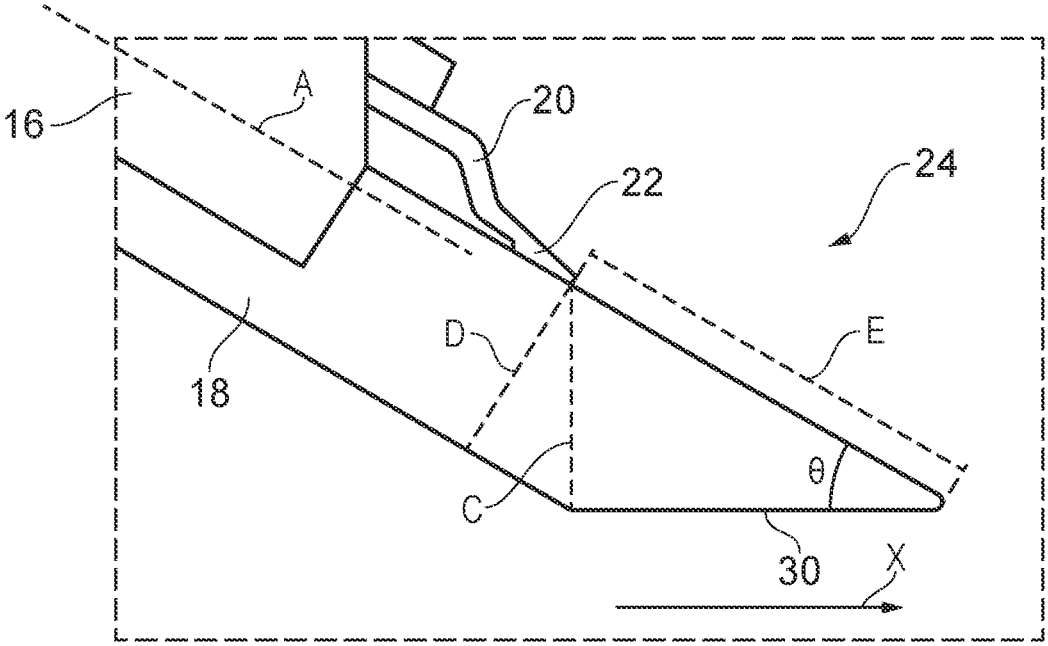

In contrast, FIG. 3 shows an enlarged view of the tip region 24 of the cutting unit 14 with the guard 18 in a second guard position corresponding to a long cutting length C between the guard contact surface 30 and the cut location. The cutting length varies as a function of the extension of the guard 18 along the extension axis and the incline angle θ at which the guard contact surface is inclined relative the blade-facing surface. In this particular example, the incline angle θ is 30°, but in other examples the incline angle θ may be higher or lower, for example between 15°-40°. Accordingly, the cutting length C is proportional to the extension of the guard with a factor of sin θ.

Similarly, the length of the guard contact surface 30 along a cutting direction X from a rear edge of the guard contact surface 30 where it meets the planar lower surface 28 towards the tip of the guard 18 (i.e. where the blade-facing surface and the guard contact surface 30 converge) is a function of the thickness of the guard 18 and the incline angle θ. The length of the cutting surface is approximately inversely proportional to sin θ. The relationship is approximate since, in this example, the distal end of the tip is rounded so that the planar guard contact surface does not correspond to the full thickness of the guard.

FIG. 3 additionally shows cutting dimensions D and E corresponding to cutting dimensions when the cutting device is held so that a surface other than the guard contact surface contacts skin of a user. For example, when the planar lower surface of the guard contacts the skin, the cutting length will be the cutting dimension D which corresponds to the thickness of the guard 18 between the blade-facing surface and the planar lower surface. As those surfaces are parallel in this example, the cutting dimension D does not vary as the guard 18 moves along the extension axis.

Further, when an distal end of the tip of the guard 18 is held against the skin so that the blade-facing surface is substantially perpendicular to the skin of the user, the cutting length will be the cutting dimension E which corresponds to the distance along the blade-facing surface between the cut location and the extreme tip.

Both cutting dimensions D, E described above correspond to unintended use of the cutting unit when a surface of the guard other than the guard contact surface contacts skin of the user.

Figure 4:
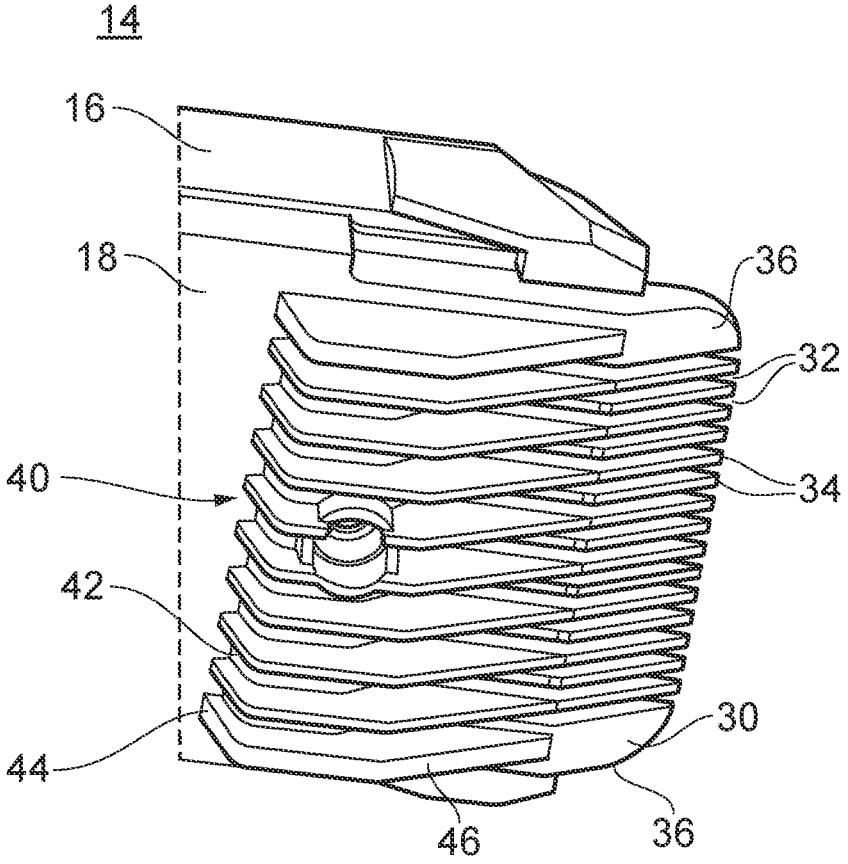
FIGS. 4 and 5 show perspective and cross-sectional views of a cutting unit respectively.
Figure 5:
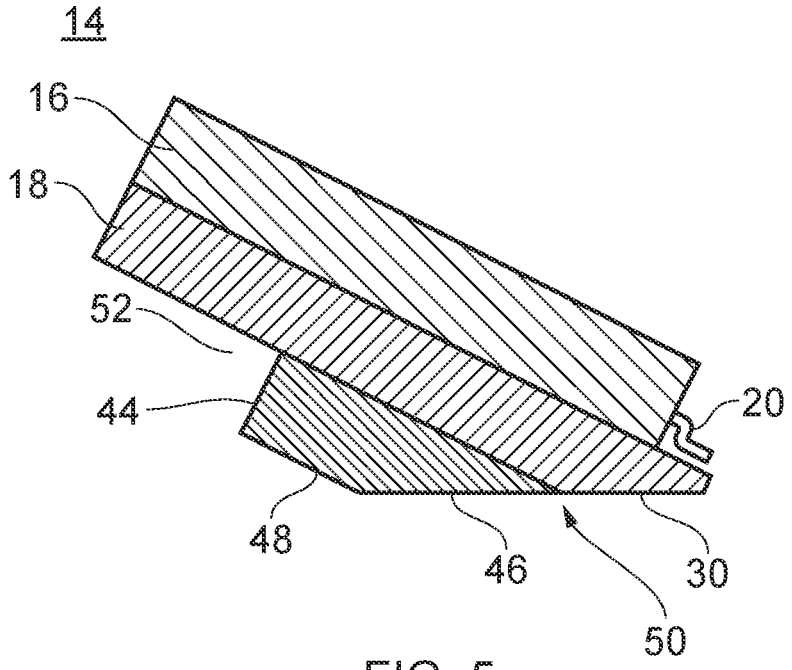

FIGS. 4 and 5 show the cutting unit 14 as provided with a guard extender 40 for extending the guard contact surface 30 of the guard 18. FIG. 4 shows the slots 32 described above which are defined between teeth 34 of the guard 18 and two side supports 36 of the guard 18. The teeth 34 and side supports 36 each have a profile at the tip of the guard 18 corresponding to that described above with respect to FIG. 3, such that the teeth 34 and side supports 36 each have a chamfered lower surface which together define the guard contact surface 30. In this example, the teeth 34 have a width of approximately 1 mm, and a tooth to tooth spacing of 1.6 mm whereas the side supports 36 have a width of approximately 5 mm. In this example, the side supports 36 are provided to contact the blade carrier 16 and protect the teeth 34. In other examples, a guard may have no side supports 36 such that the sides of the guard are defined by teeth.

In this example, the guard extender 40 comprises a body 42 for coupling to the guard 18 and a plurality of fins 44 extending from the body to together define a planar extension contact surface 46 which cooperates with the guard contact surface 30 of the guard 18, such that there is an extended contact zone 50 across the guard 18 and the guard extender 40. In this example, the body 42 is generally rectangular in cross section along the width of the guard extender 40 (i.e. along the transverse axis), and is secured to the guard 18 by a bolt or other fastener extending through an attachment hole in the body 40 and into the guard 18.

As best shown in FIG. 4, each fin is aligned with respect to a tooth 34 of the guard 18. In this particular example, every other tooth 34 is provided with a fin 44 having substantially the same width as the tooth 34, and the side supports 36 are each provided with a thicker fin 44 respectively.

As best shown in FIG. 5, the fins 44 extend below the guard 18 to define a rear lower surface 48 which in this example is parallel with the lower surface 28 of the guard 18, and to define the extension contact surface 46 which is forward of the rear lower surface 48 with respect to the cutting direction X. In this particular example, the extension contact surface 46 aligns with the guard contact surface 30 defined by the guard 18 so that, for each tooth 34 provided with a fin 44, the extension contact surface 46 is substantially flush and continuous with the guard contact surface 30. The term flush is used herein to indicate that the two surfaces lie on the same plane. The term continuous is used herein to indicate that there is substantially no gap between the two surfaces—i.e. they are contiguous with each other.

In other examples, a guard extender may have only side fins (i.e. fins or side supports towards the sides of the guard) without fins aligned with respective teeth of the guard, or there may be no fins. For example, the fins of the guard extender do not share any corresponding function with teeth of the guard, but are provided in order to define an extension contact surface that cooperates with the guard contact surface 30 of the guard 18. Accordingly, a guard extender may adopt any particular shape or configuration which provides an extension contact surface which cooperates with the guard contact surface to provide an extended contact zone.

In this example, the thickness of the guard extender 40 is greater than the thickness of the guard 18 (i.e. along an axis perpendicular to the transverse axis and the extension axis A), so that a larger proportion of the extended contact zone 50 is defined by the guard extender 40 than the guard. In other examples, the guard extender 40 may have a relatively lower thickness.

In this example, the guard extender is configured so that the length of the extended contact zone 50 along the cutting direction is greater than the length of the of the rear lower surface 48 of the guard extender along a direction parallel with the extension axis.

The applicant has found that by increasing the length of a contact zone along the cutting direction for contacting skin of a user, the stability of the cutting device against the skin is correspondingly increased, particularly with respect to rotation about a transverse axis. Users are able to perceive or recognize the stability of the device against the skin by the response of the cutting device 10 in their hand as they manipulate it. Correspondingly, the applicant has found that the stability of the cutting device against the skin is lower when surfaces having a lower length contact the skin.

A user is able to rock or pivot the cutting device 10 against their skin (e.g. about an transverse axis) so that different surfaces of the cutting unit 14 contact their skin. With respect to the example cutting device 10 of FIGS. 4 and 5, a user may rock the cutting device 10 between a first orientation in which the extreme tip of the guard contacts the skin; a second orientation in which the extended contact zone 50 contacts their skin; a third orientation in which the rear lower surface 48 of the guard extender 40 contacts their skin; and a fourth orientation in which the skin bridges a valley portion 52 between the rear edge of the rear lower surface 48 and a rear edge of the guard 18. The term "valley portion" is used herein to refer to a portion in the profile of the cutting unit 14, rearward of the guard contact surface, which is depressed or recessed relative adjacent portions of the profile of the cutting unit, such as a rear edge of the cutting unit or the rear edge of the guard contact surface. A valley portion of the profile can be considered as a portion which is depressed or recessed relative any plane (i.e. not necessarily a plane aligned with a planar surface of the guard) that would bridge the valley—in other words a plane that would lie over the valley portion in contact with adjacent formations so that there is a void within the valley portion.

In the first and third orientations described above, the length of the respective surface that contacts the skin along a cutting direction perpendicular to the width direction of the guard 18 (or of the blade) is lower than in the second orientation. As such, the stability of the device may be correspondingly lower such that the user may determine that the cutting device is held in an incorrect orientation. In the fourth orientation, the skin would bridge the valley 52 so that the skin would be contacted by two discrete edges rather than an extended contact zone. Such bridging contact would be detected by the user and considered abnormal in comparison to contact with an extended contact zone, such that a user may determine that the cutting device is held in an incorrect orientation.

Accordingly, providing the extended contact zone over the guard 18 and guard extender 40 may improve stability of the cutting device against a user's skin such that it is easier to retain the device in the intended orientation, and a user is more likely to recognise when the device is held in correct and incorrect orientations for use respectively.

Figure 6:
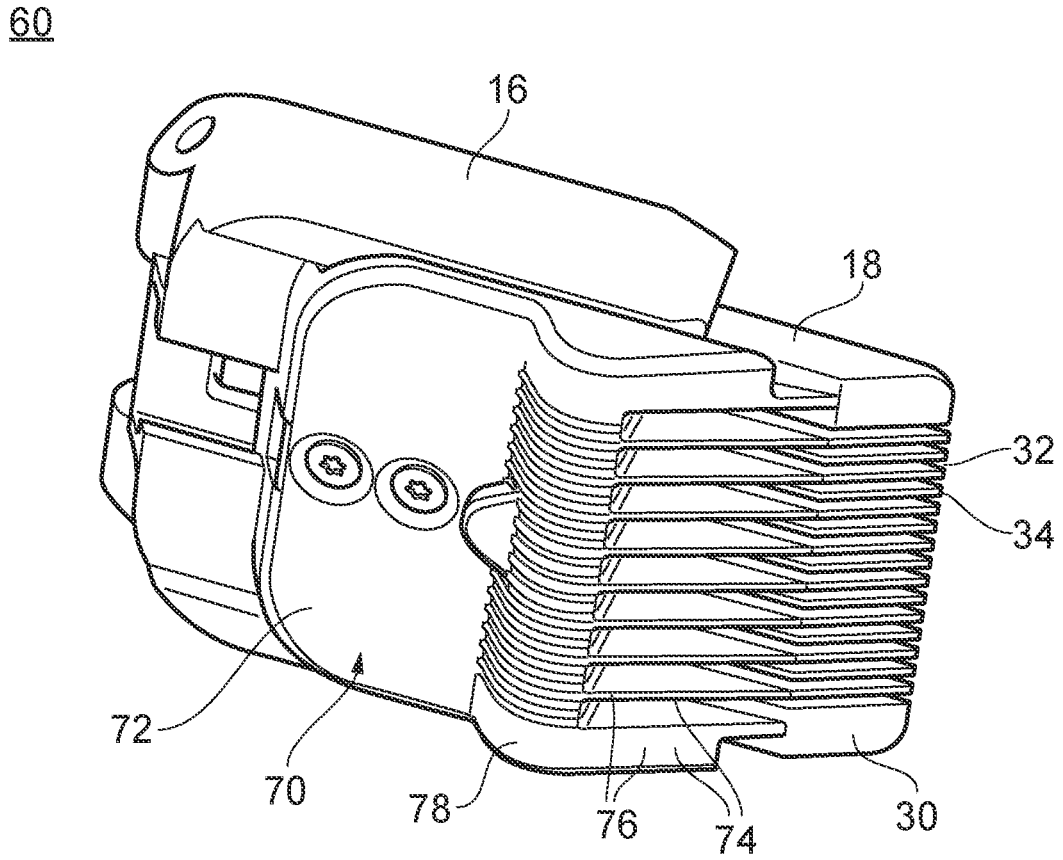
FIGS. 6 and 7 show perspective and cross-sectional views of a cutting unit respectively.
Figure 7:
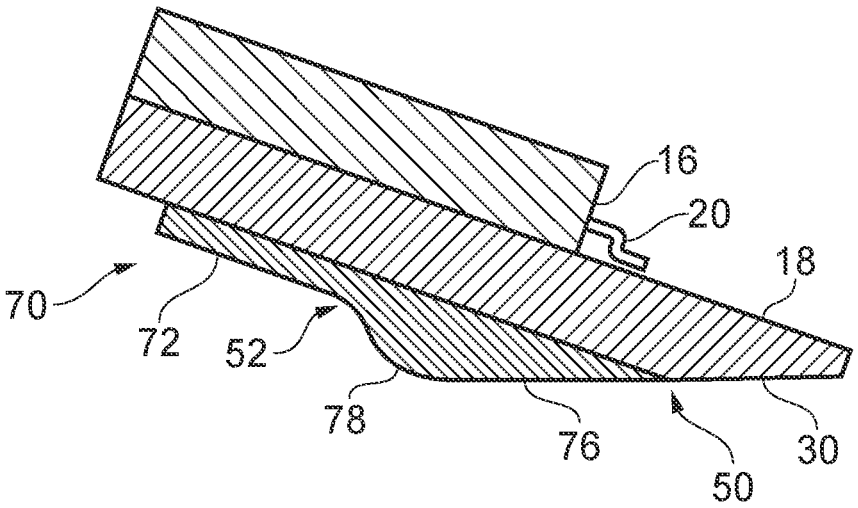

FIGS. 6 and 7 show a further example of a cutting unit 60 for the cutting device 10 of FIG. 1. The cutting unit 60 comprises a blade carrier 16 and a guard 18 substantially as described above with respect to FIGS. 1-5.

The cutting unit 60 comprises a guard extender 70 having an aft body 72 and an integral forward set of fins 74. In this example, the aft body 72 is generally in the form of a squat cuboidal layer configured to conform to the planar lower surface 28 of the guard 18. In this example, the guard extender 70 is mounted on the guard 18 by two bolts or other fasteners which extend through attachment holes through the aft body into the guard 18.

The forward fins 74 extend forward and below the aft body 72 (in the orientation shown in FIGS. 6 and 7) so that the cross-sectional profile of the guard extender 70 has a half-arrowhead profile (i.e. an arrowhead bisected along its line of symmetry).

The fins 74 have slots therebetween corresponding to slots 32 between teeth 34 of the guard 18. As in the guard extender 40 of FIGS. 4-5, in this example the slots between fins 74 extend over two slots 32 and one tooth 34 of the guard 18 (i.e. there is one fin 74 for every two teeth 34 of the guard).

The fins 74 together define a planar extension contact surface 76 which cooperates with the guard contact surface 30 of the guard 18 as described above to provide a substantially planar extended contact zone across the guard 30 and the guard extender 70 for contacting skin of a user.

Accordingly, the guard extender 70 serves to increase the length of a contact zone across the guard 18 and guard extender 70 for contacting skin of a user, to provide improved stability of the cutting device 10 against the skin of the user as described above.

In this example, the fins 76 define a convex apex 78 rearward of the extension contact surface 76. The convex apex 78 is configured to contact skin of the user when the cutting device 10 is rotated to lift the tip of the guard 18 away from the skin of the user. The convex apex 78 may therefore be considered to define a convex rocker surface of the guard extender 70.

The convex apex (or convex rocker surface) permits easy rotation of the cutting device 10 against the skin of the user, such that the stability of the cutting device 10 when the convex apex 78 contacts the skin is relatively low. Accordingly, when the convex apex 78 is held against a user's skin, the user may recognize that the device 10 is held in an incorrect orientation based on the stability of the device.

Continued rotation of the cutting device to lift the tip of the guard 18 away from skin of the user would cause the skin to bridge a valley 52 defined between the convex apex 78 and a rear edge of the cutting unit 60. In this example, the valley 52 is defined between the convex apex 78 and the rear edge of the aft body 72. As described above with respect to FIGS. 4 and 5, such bridging contact may be recognized by the user, such that they may determine that the cutting device is held in an incorrect orientation.

Figure 8:
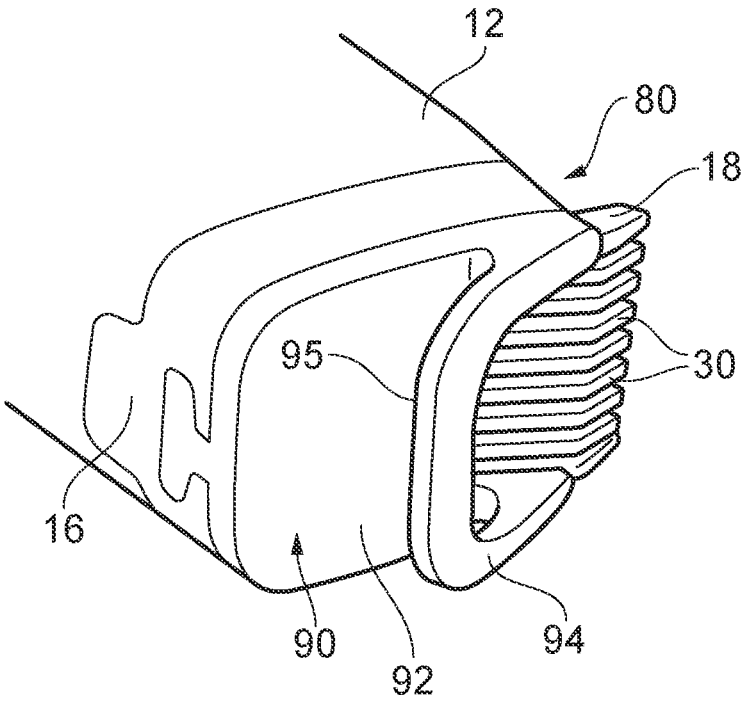
FIGS. 8 and 9 show perspective and cross-sectional views of a cutting unit, respectively.
Figure 9:
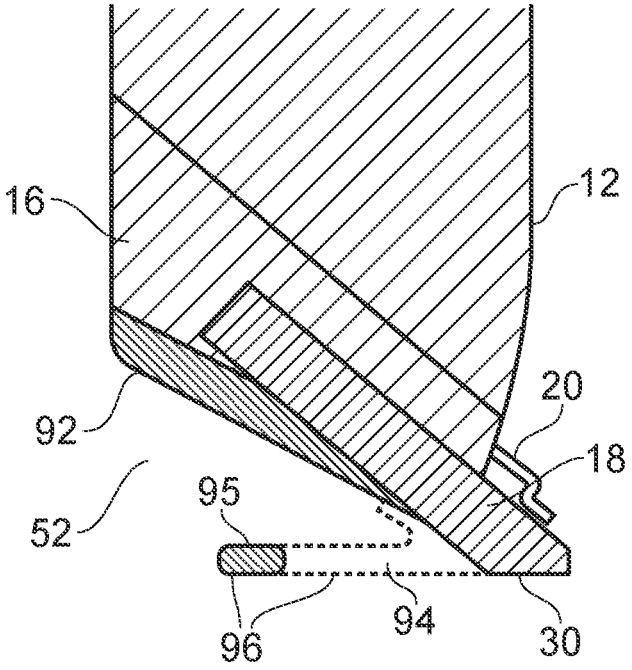

FIGS. 8 and 9 show a further example of a cutting unit 80 for the cutting device of FIG. 1, this example providing an embodiment of the invention as claimed. As with the first and second examples described above with respect to FIGS. 4-7, the cutting unit 80 comprises a blade carrier 16 carrying a cutting blade 20, and a guard 18 mounted to and moveable with respect to the blade carrier 16.

In this example, the cutting unit 80 comprises a guard extender 90 in the form of a spoiler that extends rearwardly form the guard contact surface 30. The guard extender 90 has an attachment body 92 mounted to the guard 18 so that it overlies the rear lower surface of the guard 18 as described above.

The guard extender 90 comprises two side supports 94 that extend below the attachment body 92 from a forward portion attachment body 92 to define side contact portions of an extension contact surface 96 that cooperate with the guard contact surface 30 of the guard 18 to provide a substantially planar extended contact zone. The side supports 94 extend rearwardly to support a transverse contact member 95 (or "crossbar") between them, such that the side supports 94 and transverse contact member 95 together define a horseshoe, U-shaped or spoiler profile rearwardly of the guard contact surface. The transverse contact member 95 defines a transverse contact portion of the extension contact surface 96 that aligns with the guard contact surface 30 of the guard 18. Accordingly, the side contact portions and the transverse contact surface together define an extension contact surface 96 that aligns with the guard contact surface 30 to provide an extended contact zone across the guard 18 and the guard extender 90 for contacting skin of the user.

In this example, there is a gap between the guard contact surface 30 and the transverse contact portion of the extension contact surface 96 such that the transverse contact portion is not contiguous with the guard contact surface 30, in the plane of the extended contact zone across the guard 18 and the guard extender 90. Nevertheless, the transverse contact portion aligns with the guard contact surface 30 such that they cooperate to provide the extended contact zone. In this particular example, the transverse contact portion aligns with the guard contact surface 30 so that they lie in substantially the same plane. In this particular example, the side contact portions of the extension contact surface 96 align with the guard contact surface 30 so that they are contiguous with respective portions of the guard contact surface 30. However, in other examples, a guard extender may be configured so that no portion of an extension contact surface is contiguous with the guard contact surface.

In this example, the extension contact surface 96 is inclined relative a surface of the attachment body 92. The side supports 94 and the transverse contact member 95 project away from the attachment body 92 so that there is a passageway 52 between the transverse contact member 95 and the attachment body 92, and thereby between the transverse contact member 95 and the guard 18. By providing a passageway 52, the material resources to manufacture the guard extender 90 may be reduced. The passageway 52 may also permit grooming products to pass through the passageway 52, rather than between the transverse contact member and the user's skin. Further, the spoiler design of this example provides a gap rearward of the teeth of the guard, as opposed to a series of fins aligned with those teeth. Accordingly, the gap may prevent any hairs becoming trapped between interfaces between guard teeth and guard extender fins in use.

Figure 10:
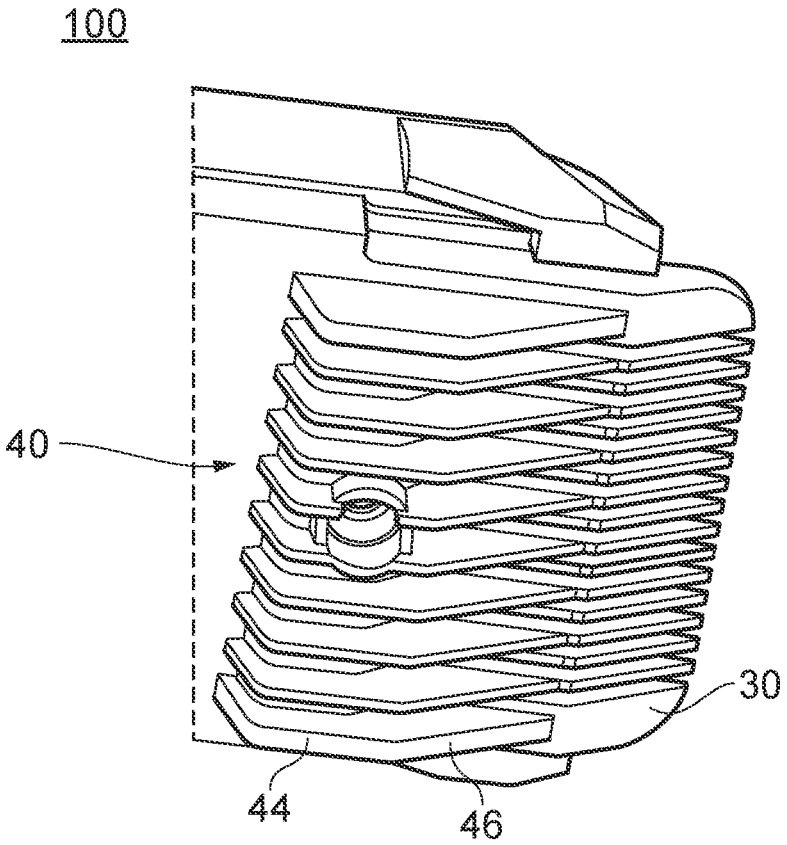
FIGS. 10 and 11 show perspective and cross-sectional views of a cutting unit respectively.
Figure 11:
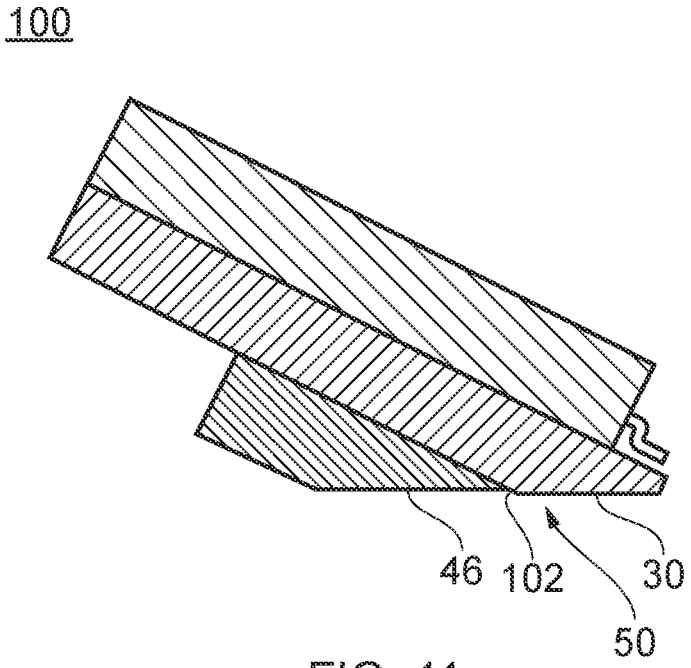

FIGS. 10 and 11 show a cutting unit 100 substantially as described above with respect FIGS. 4 and 5, but differing in the alignment of the extension contact surface 46 of the guard extender 40, and the guard contact surface of the guard. Whilst in the example cutting unit 14 described above with respect to FIGS. 4 and 5 such surfaces are flush with one another, in this example they are substantially planar permitting a small step 102 between the guard contact surface 30 and the extension contact surface 46, for example up to 1 mm.

The small step may prevent or inhibit pinching of skin or catching of hair at a joint between the guard extender and the guard (i.e. at the boundary between the guard contact surface and the extension contact surface). As shown, in this example the step is defined by the extension contact surface being recessed from the guard contact surface so that in use skin bridges from a rear end of the guard contact surface onto the extension contact surface.

While the invention has been illustrated and described in detail in the drawings and foregoing description, such illustration and description are to be considered illustrative or exemplary and not restrictive; the invention is not limited to the disclosed embodiments. Various alternative examples are discussed throughout the detailed description.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A cutting unit for a hair cutting device, comprising:

a blade carrier carrying a cutting blade;

a guard comprising:

a blade-facing surface engaging the cutting blade at a cut location;

a planar guard contact surface for contacting skin of a user;

a plurality of hair-receiving slots extending between the guard contact surface and the blade-facing surface;

wherein the guard contact surface is angled with respect to the blade-facing surface; and a guard extender separate from the guard, wherein the guard extender comprises a planar extension contact surface configured to cooperate with the guard contact surface to provide an extended contact zone across the guard and the guard extender for contacting skin of a user, wherein the blade-facing surface and the guard contact surface converge towards a tip of the guard, wherein a cutting direction extends along the guard contact surface towards the tip, and wherein the guard extender is configured so that the planar extension contact surface is rearward of the guard contact surface with respect to the cutting direction, and wherein the planar extension contact surface has a transverse extent along an axis perpendicular to the cutting direction, and wherein there is a gap along the cutting direction between the guard contact surface and at least a transverse contact portion of the planar extension contact surface such that the transverse contact portion is not contiguous with the guard contact surface in the plane of the extended contact zone across the guard and the guard extender, and wherein the extension contact surface is inclined relative to a surface of an attachment body of the guard extender, and wherein the attachment body attaches the guard extender to the guard.

2. The cutting unit according to claim 1, wherein the guard extender is removably mounted to the guard.

3. The cutting unit according to claim 1, wherein the guard extender comprises a transverse contact member defining the transverse contact portion of the planar extension contact surface, and wherein there is a passageway between the transverse contact member and the attachment body.

4. The cutting unit according to claim 1, wherein the extension contact surface comprises at least one side support, which side support is continuous with the guard contact surface.

5. The cutting unit according to claim 1, wherein the guard is moveable along the blade carrier to vary the cutting length of the cutting unit.

6. A hair cutting device comprising a housing unit and the cutting unit of claim 1.

* * * * *